US009067107B2

(12) United States Patent
Solhaug

(10) Patent No.: US 9,067,107 B2
(45) Date of Patent: Jun. 30, 2015

(54) METHOD AND SYSTEM FOR GOLF CLUB WEIGHT ADJUSTMENT

(71) Applicant: Gisle Solhaug, Risoyveien (NO)

(72) Inventor: Gisle Solhaug, Risoyveien (NO)

( * ) Notice: Subject to any disclaimer, the term of this patent is extended or adjusted under 35 U.S.C. 154(b) by 16 days.

(21) Appl. No.: 14/151,780

(22) Filed: Jan. 9, 2014

(65) Prior Publication Data

US 2014/0144879 A1 May 29, 2014

Related U.S. Application Data

(63) Continuation-in-part of application No. 13/817,099, filed as application No. PCT/NO2011/000219 on Aug. 2, 2011.

(51) Int. Cl.

| | |
|---|---|
| ***A63B 53/12*** | (2015.01) |
| ***A63B 59/00*** | (2015.01) |
| ***A63B 53/00*** | (2015.01) |
| *A63B 53/16* | (2006.01) |
| *A63B 53/14* | (2015.01) |
| *A63B 53/04* | (2015.01) |

(52) U.S. Cl.

CPC ..... *A63B 59/0074* (2013.01); *A63B 53/16* (2013.01); *A63B 53/00* (2013.01); *A63B 53/145* (2013.01); *A63B 2053/005* (2013.01); *A63B 2053/0491* (2013.01)

(58) Field of Classification Search

CPC ..... A63B 53/145; A63B 53/16
USPC ..... 473/297, 318
See application file for complete search history.

(56) References Cited

U.S. PATENT DOCUMENTS

| | | | | |
|---|---|---|---|---|
| 4,541,631 | A * | 9/1985 | Sasse | 473/297 |
| 5,082,279 | A * | 1/1992 | Hull et al. | 473/242 |
| 5,607,364 | A * | 3/1997 | Hedrick et al. | 473/318 |
| 5,643,111 | A * | 7/1997 | Igarashi | 473/332 |
| 7,481,716 | B1 | 1/2009 | Johnson | |

* cited by examiner

*Primary Examiner* — Benjamin Layno
(74) *Attorney, Agent, or Firm* — John Lindsay

(57) ABSTRACT

There is provided a method and system for adjusting the weight of a golf clubs. The method includes receiving a target additional weight for the golf club. A weighted filler is selected corresponding to the target additional weight and the interior volume of the golf club. The initially viscous weighted filler is injected into the golf club interior and allowed to cure.

6 Claims, 8 Drawing Sheets

| Body Member | Mass | Length | CG from top | CG from Spine | Moment | MOI | MOI at Spine |
|---|---|---|---|---|---|---|---|
| Upper arm | $M_{UA}$ | $L_{UA}$ | $CG_{UA}$ | $CGS_{UA}$ | $MOM_{UA}$ | $MOI_{UA}$ | $MOIS_{UA}$ |
| Forearm | $M_{FA}$ | $L_{FA}$ | $CG_{FA}$ | $CGS_{FA}$ | $MOM_{FA}$ | $MOI_{FA}$ | $MOIS_{FA}$ |
| Hand (closed) | $M_H$ | $L_H$ | $CG_H$ | $CGS_H$ | $MOM_H$ | $MOI_H$ | $MOIS_H$ |
| Shoulder width | | $L_{SW}$ | | | | | |

Figure 6

| Body Member | Mass [Kg] | Length [mm] | CG from top [mm] |
|---|---|---|---|
| Upper arm | 3.4% of TBM | 18.6% of TBH | 43% of $L_{UA}$ |
| Forearm | 2.2% of TBM | 14.6% of TBH | 41% of $L_{FA}$ |
| Hand (closed) | 0.8% of TBM | 5.4% of TBH | 50% of $L_H$ |
| Shoulder width | | 25.9% of TBH | |

Figure 7

| BioMatch Application Input Data Sheet | | | | | | | | |
|---|---|---|---|---|---|---|---|---|
| Golfer Data | | | | | | | | |
| Body Height | 178 | cm | | | | | | |
| Body Weight | 74 | Kg | | | | | | |
| Grip End length | 100 | mm | | | | | | |
| T-Upp Distance | | mm | Default is body height x 174 / 1800 | | | | | |
| Club Data | | | | | | | | |
| Club Name | Club Type | Minimum Weight | Preferred length | Measured MOIG | Lie Angle | Head Drag Coeff. | Club Head Width | Club Head Height |
| | [I, H, W] | [g] | [mm] | [Kg x cm^2] | [Degrees] | [ ] | [mm] | [mm] |
| L Wedge | I | 431 | 902 | 1996 | 66.50 | 0.90 | 80 | 50 |
| S Wedge | I | 437 | 909 | 2044 | 66.25 | 0.90 | 80 | 50 |
| U Wedge | I | 432 | 916 | 2044 | 66.00 | 0.90 | 80 | 50 |
| P Wedge | I | 428 | 923 | 2045 | 66.00 | 0.90 | 80 | 50 |
| 9 Iron | I | 423 | 930 | 2045 | 65.75 | 0.90 | 80 | 50 |
| 8 Iron | I | 412 | 937 | 2062 | 65.00 | 0.90 | 80 | 50 |
| 7 Iron | I | 410 | 944 | 2079 | 64.25 | 0.90 | 80 | 50 |
| 6 Iron | I | 399 | 956 | 2082 | 63.50 | 0.90 | 80 | 50 |
| 5 Iron | I | 387 | 968 | 2085 | 62.75 | 0.90 | 80 | 50 |
| 4 Iron | I | 380 | 981 | 2090 | 62.00 | 0.90 | 80 | 50 |
| 18 Hybrid | H | 345 | 1014 | 2058 | 59.00 | 0.75 | 80 | 55 |
| 3 Wood | W | 302 | 1062 | 2056 | 56.50 | 0.63 | 80 | 60 |
| Driver | W | 279 | 1100 | 2027 | 58.00 | 0.60 | 100 | 70 |

Figure 8

| Club Data | | | | | |
|---|---|---|---|---|---|
| Club Name | Club Type | Total Weight | Back Weight | Length | Target MOIG |
| | [I, H, W] | [g] | [g] | [mm] | [Kg x cm^2] |
| L Wedge | I | 471 | 40 | 902 | 2096 |
| S Wedge | I | 462 | 25 | 909 | 2095 |
| U Wedge | I | 454 | 22 | 916 | 2095 |
| P Wedge | I | 445 | 17 | 923 | 2094 |
| 9 Iron | I | 437 | 14 | 930 | 2094 |
| 8 Iron | I | 429 | 17 | 937 | 2093 |
| 7 Iron | I | 421 | 11 | 944 | 2093 |
| 6 Iron | I | 407 | 8 | 956 | 2092 |
| 5 Iron | I | 394 | 7 | 968 | 2091 |
| 4 Iron | I | 380 | 0 | 981 | 2090 |
| 18 Hybrid | H | 408 | 63 | 1014 | 2089 |
| 3 Wood | W | 435 | 133 | 1062 | 2087 |
| Driver | W | 408 | 129 | 1100 | 2072 |

| BioMatch Index Fine Tuning | | | | | |
|---|---|---|---|---|---|
| Club Name | Target BMI | Tuning Weight | Tuning Length | Tuning MOIG | Resulting BMI |
| | [mm^2 ] | [g] | [mm] | [Kg x cm^2] | [mm^2 ] |
| L Wedge | 44.5 | 471 | 902 | 2,096 | 44.5 |
| S Wedge | 45.3 | 462 | 909 | 2,095 | 45.3 |
| U Wedge | 46.2 | 454 | 916 | 2,095 | 46.2 |
| P Wedge | 47.0 | 445 | 923 | 2,094 | 47.0 |
| 9 Iron | 47.9 | 437 | 930 | 2,094 | 47.9 |
| 8 Iron | 48.8 | 429 | 937 | 2,093 | 48.8 |
| 7 Iron | 49.7 | 421 | 944 | 2,093 | 49.7 |
| 6 Iron | 51.3 | 407 | 956 | 2,092 | 51.3 |
| 5 Iron | 53.0 | 394 | 968 | 2,091 | 53.0 |
| 4 Iron | 54.9 | 380 | 981 | 2,090 | 54.9 |
| 18 Hybrid | 51.2 | 408 | 1,014 | 2,089 | 51.2 |
| 3 Wood | 48.0 | 435 | 1,062 | 2,087 | 48.0 |
| Driver | 50.8 | 408 | 1,100 | 2,072 | 50.8 |

Figure 9

METHOD AND SYSTEM FOR GOLF CLUB WEIGHT ADJUSTMENT

BRIEF DESCRIPTION OF THE DRAWINGS

For a more complete understanding of the present invention, including its features and advantages, reference is now made to the detailed description of the invention taken in conjunction with the accompanying drawing in which:

FIG. 6 shows a table of abbreviations used in the description and the Figures;

FIG. 7 shows a table of the factors used to determine the physical parameters of the user;

FIG. 8 shows a table of data being input to carry out the method of FIG. 1;

FIG. 9 shows a table of data being output from carrying out the method of FIG. 1;

DETAILED DESCRIPTION OF THE INVENTION

Figure 1:
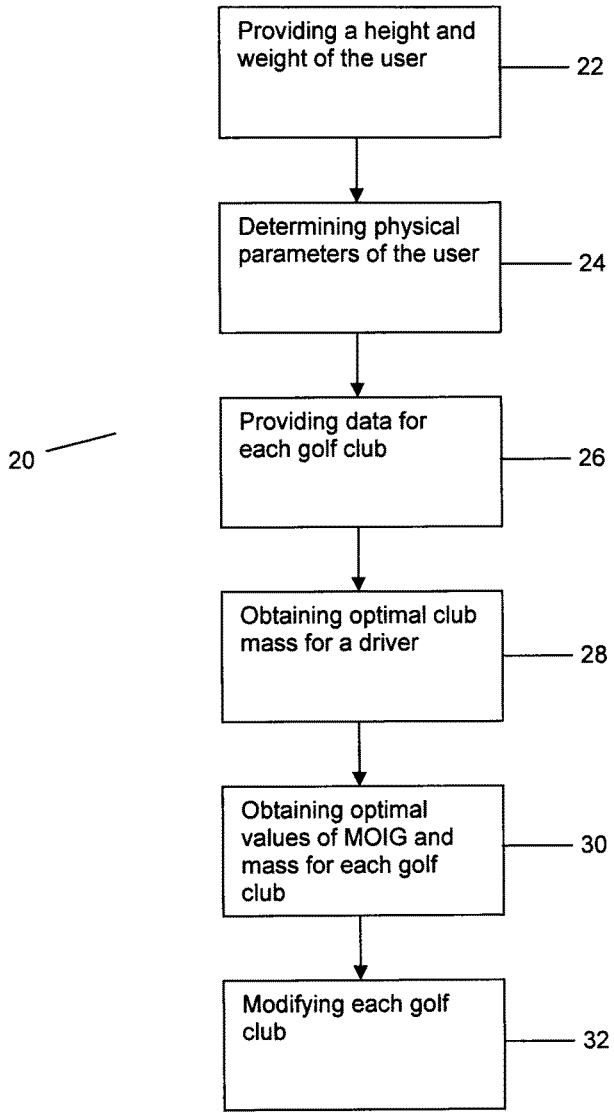
FIG. 1 shows a process flow for a method of the present invention.

While the making and using of various embodiments of the present invention are discussed in detail below, it should be appreciated that the present invention provides many applicable inventive concepts that may be embodied in a wide variety of specific contexts. The specific embodiments discussed herein are merely illustrative of specific ways to make and use the invention and do not delimit the scope of the invention.

The present invention relates to the field of sporting equipment, specifically, a method and system for matching golf clubs to a specific user with the golf clubs correspondingly being matched with each other.

Currently, golf clubs are typically fitted to a user based on parameters such as a height of the player and a distance from the user's wrists to the floor. These parameters are correspondingly used to determine both the lie angle and the length of clubs. In addition, choice of club head is based on the user's capabilities and preferences, shaft flex is determined by the user's typical club head speed while size of grip is determined by the size of the user's hands.

Traditionally golf clubs in a set of golf clubs are matched by a non-scientific measurement called "Swingweight". "Swingweight" is commonly perceived to be a subjective measure of how the mass of the club feels during a swing of a golf club. Obtaining a "Swingweight" of the golf club involves measuring an upward force at a gripping end of the club when the club is balanced at a predetermined distance along the shaft of the golf club. "Swingweight" of the club is usually expressed as "C10" or "01" or some other combination of letter and number which is not related to any physical property of the club. In truth, the "Swingweight" of a golf club does not in any way describe how the club will behave during a swing. For instance, it does not make sense that the "Swingweight" of a golf club is reduced by adding a mass to the gripping end of the club. Unfortunately, reliance on "Swingweight" measurements to match golf clubs within a set is convenient for mass market club manufacturers/club fitters. This is not beneficial to the user as the user typically needs to master different swings for each golf club in the set.

It is evident that consistently mastering different swings for each golf club in the set is a difficult endeavour for any user. It would be difficult for the user to consistently replicate the mechanics of the different swings for each golf club. In this regard, it is advantageous if there was a method to match a set of golf clubs to a user whereby the user is able to rely upon only one type of swing to effectively use all the golf clubs in the set.

In view of bibliographical purposes, in FIG. 7, the Mass and Centre of gravity from the upper end of body segment is given by the publication "WEIGHT, VOLUME AND CENTER OF MASS OF SEGMENTS OF THE HUMAN BODY" by Charles E. Clauser (Aerospace Medical Research Laboratory), John T McConville (Antioch College) and J. W. Young (Civil Aeromedical Institute) Published August 1969. The above tabulated figures may be further enhanced by correcting for the persons BMI (Body Mass Index). It may also be enhanced by using further studies that take sex and race into consideration. In FIG. 7, the length of body members are provided by the "Open design lab", Proportionality Constants (www.openlab.psu.edu). Further to the table it should be noted that the floor to hip joint length is 53.0% of overall body height. The length of the core from hip joint to shoulder intersection at core is 28.8% of overall body height. The distance between hip joints are 19.1% of the overall body height.

In a first aspect, there is provided a method for matching golf clubs to a specific user. The method includes providing both a height and a weight of the specific user; determining physical parameters of the specific user from both the height and the weight; providing data for each golf club; obtaining optimal club mass for a Driver; obtaining optimal values of both a moment of inertia about a grip centre and a mass for each golf club; and modifying each golf club to enable each golf club to attain the optimal values. It is advantageous that each of the golf clubs matched to the specific user are effectively employed with an application of identical swings from the specific user. The effective employment of each of the golf clubs may relate to both distance and accuracy of a ball struck by each of the golf clubs.

The optimal club mass of the Driver may preferably be obtained using a process including measuring Driver head speed when swinging the Driver with different weights added to a grip end of the Driver, with the optimal club mass of the Driver is when the Driver head speed is at a highest value.

It is preferable that the data for each golf club includes type of each golf club; mass of each golf club; length of each golf club; measured moment of inertia about a grip centre value of each golf club; lie angle of each golf club; club head drag coefficient of each golf club; club head width of each golf club; and club head height of each golf club.

Preferably, the physical parameters of the specific user include length, mass, position of centre of gravity of each upper arm; length, mass, position of centre of gravity of each forearm; length, mass, position of centre of gravity of each hand; and distance of shoulder width.

It is preferable that the modification of each golf club includes at least one technique like, for example, adjustment of club head weights, adjustment of club lengths, adjustment of club weights and so forth. The adjustment of club weights may be carried out using a plurality of cylindrical sleeves of varying masses, with a centre of gravity of each cylindrical sleeve being at the grip centre of each golf club.

While the aforementioned method involves a lot of calculations, this may be easily overcome by using a spreadsheet or an application that can be run on anything from an iPhone to a computer.

In a second aspect, there is provided a system for performing the aforementioned method, the system being set up with a plurality of modules to carry out processes of the method, where the modules may be located at either a single location or a plurality of locations.

The plurality of modules may preferably include a data generator of both physical parameters of the specific user and optimal values for golf clubs; a swing analyzer to obtain an optimal club mass for a Driver; and a golf club modifier to modify each golf club. The optimal values for golf clubs are for both a moment of inertia about a grip centre and a mass for each golf club.

For most golfers the clubs will be made as light as possible while still satisfying the aforementioned method. This advantageously allows the user to complete a competition or training session without too much strain.

The present invention will be described in the following paragraphs in an illustrative manner, which will aid a skilled artisan in obtaining a better understanding of the present invention. Fundamental concepts are described in subsequent paragraphs to provide the skilled artisan with the information to understand the present invention in a manner which enables the present invention to be put to practice. Reference is made to FIG. 6 to provide a guide to abbreviations used in the subsequent paragraphs of the description.

Referring to FIG. 7 which contains additional abbreviations, TBM is Total Body Mass in Kg while TBH is Total Body Height in mm. Some other abbreviations used in the description will be described at the point which they are utilized.

The present invention takes into account physical properties of golf clubs. In order for a blindfolded user not to be able to differentiate between the clubs within a set of golf clubs while swinging each of the clubs, all the clubs would have to have the same mass, centre of gravity and the same moment of inertia taken around the point of which the person is holding the club.

Depending on hand size, this point of rotation is typically located about 100 mm down the shaft from an end edge of a golf grip. The mass affects "feel" of the club when the club is held still, while the moment of inertia affects "feel" of the club when the club is rotated about the golf grip. As such, references in subsequent portions of the description will refer to the mass and the moment of inertia about the golf grip (MOIG).

A golf swing can be described as two combined movements inter-related with each other. A first movement involves movement of the club from the top of the backswing and to impact. The first movement is controlled by a user's arms, which moves in a circular motion about the left shoulder. Since the shoulder rotates around a core of the user's upper body, this correspondingly causes the grip of the club (approximately at 100 mm down the shaft) to move in an elliptical pattern. Subsequently, the mass of the club affects how the club moves during the swing. A second movement relates to a circular motion the club makes relative to the user's hands. The club typically turns around a point approximately 100 mm down the shaft from the end edge of a golf grip. The MOIG affects how the club rotates. Thus it should be appreciated that both mass and MOIG affects the club during the golf swing by the user (when air resistance is ignored). When MOIG is corrected to take air resistance into account, the MOIG of longer clubs become marginally lower than that of the other clubs. This is especially notable for clubs with large club heads such as the woods.

As discussed earlier, the MOIG affects how the club rotates around the centre of the grip while the mass of the club affects the accelerations of the hands. It should be appreciated that the mass and physical properties of the user's upper limbs have to be considered together with the properties of the club.

This will be more clearly illustrated in the subsequent paragraphs.

MOIG

| | | |
|---|---|---|
| Individual MOIG | Correction for air resistance OR | MOIG Constant |
| Individual MOIG | MOIG Constant | Correction for air resistance |

For all the clubs to rotate around the centre of the grip in an identical manner the MOIG must be the same for all clubs. However when considering air resistance it is found that the clubs must have small variations in MOIG. This in order for the club heads to be delivered to the impact point at the same moment in time. This has in particular an impact on the Driver due to the large modern Driver heads.

"MOIG Constant" is the MOIG of the club with the lowest MOIG without considering the air resistance. The club with the lowest MOIG in a traditional set of golf clubs is normally the shortest club. The MOIG can be obtained by measurement using a suitable MOI measuring device or it can be calculated as the sum of the MOI of all the clubs components about the centre of the grip.

Maximum club head speed is measured of the user using a club of a measured length. If the user is not present and no means of measuring the club head speed is available it can be estimated by for example how long the user hits a 7 Iron. Once the club head speed at impact is established the angular velocity, $\acute{\omega}$, at the time of impact can be calculated as:

$$\acute{\omega}=v/r$$

where, v=club head speed at impact r=club length measured from the centre of the grip, G Angular Acceleration, $\alpha$, is found from Newton's laws:

$$\acute{\omega}=\acute{\omega}^2_0+2\alpha\theta$$

where, $\acute{\omega}$=Angular velocity at impact $\acute{\omega}_0$=Initial angular velocity $\alpha$=Angular acceleration $\theta$=Angle in which the club rotate around the centre of the grip from the top of the backswing to point of impact. This angle is 90 degrees, or $\pi/2$.

As the initial velocity at top of the backswing is zero, angular acceleration from top of the backswing to impact is calculated as follows:

$$\alpha=\acute{\omega}^2/2\theta$$

Air resistance, drag, is a force acting in the opposite direction of the club head movement.

$$F_{drug}=\tfrac{1}{2}CpAv_2$$

where,

C=drag coefficient p=air density, approximately 1.29

A=cross sectional area from front view, can easily be calculated

The drag coefficient of each club head must be estimated or established by testing. A simple estimation based on the following principle may be sufficient.

The drag coefficient is 0.5 for a sphere and can reach 2 for irregular shapes. One may generalize as follows:

Drag coefficient for Irons=0.90

Drag coefficient for Hybrids=0.75

Drag coefficient for Woods=0.63

Drag coefficient for Driver=0.60

The above are general estimates. Better estimates may be obtained by testing of the actual club heads being fitted.

The Maximum Torque around the grip centre created by the drag, opposing the movement of the club, is as follows:

$$t_{drag\ max}=f_{drag\ max}\times \text{lever}$$

Where, lever is the distance from the centre of grip to centre of club head.

The average Torque created by air resistance can be estimated to be half of the Maximum Torque. Using advanced calculus or computer modeling, more exact results can be achieved. Thereby:

$$t_{drag}=t_{drag\ max}/2$$

By applying Newton's second law to circular motion:

$$\text{MOIG}_{correction}=t_{drag\ max}/\alpha$$

The MOIG of each individual club can thereby be determined as:

$$\text{MOIG}_{Individual}=\text{MOIG}_{Constant}-\text{MOIG}_{Correction}$$

It was however found that the results of these calculations are independent of the club head speed. There is thereby no need to enter the club head speed as it cancels itself out in the calculations. This as the $v^2$ part of the $t_{drag}$ is i proportional to the $\acute{\omega}^2$ in the $\alpha$ of the above equation for $\text{MOIG}_{correction}$. Correspondingly, there is no need to adjust clubs as the user progresses to higher club head speeds.

Mass of Clubs

For the user's hands to come to the same position at impact for all the clubs, all the clubs should have the same mass. However it is desirable for the user's hands to be a bit more forward at impact for the longer iron clubs and Hybrids compared to the shorter iron clubs. In this regard, there's a need to include a correction for the hand position when considering the mass of each club. Desired hand position at impact may vary from player to player, therefore the user may choose which hand position is preferred for each club by indicating whether the club should be considered an Iron, Hybrid or Driver.

For example, if a Wood is considered to be played as a Hybrid, the club will become lighter in order to achieve this.

The correction factor for the hand position at an instance of impact consists of two components. A first component is due to the differences in the length of the club. The longer iron clubs leaves the hands further forward as the club is assumed to be an elongation of the left arm. It should be noted that for the Woods and Driver the shaft is normally not played as an elongation of the left arm. Normally these clubs are played with the shaft perpendicular to the target line. The Hybrid clubs can be assumed to straddle the middle ground between the Woods and Irons.

A second component is due to the actual ball position at setup. For the Driver the ball is typically positioned further forward in the stance compared to the shorter clubs.

As such,

| | | |
|---|---|---|
| Total Club Mass | Correction for hand position | Constant throughout the set of Golf Clubs |
| | OR | |
| Total Club Mass | Constant throughout the set of Golf Clubs | Correction for hand position |

"Constant throughout the set of Golf clubs" is normally defined as the mass of the Driver as it is typically the lightest club.

"Correction for hand position" is normally zero for the longest iron club. No correction mass is thereby added to the longest iron. While this normally holds true, it is not a firm rule.

Centre of Gravity of the Various Body Members from the Spine

Figure 2:
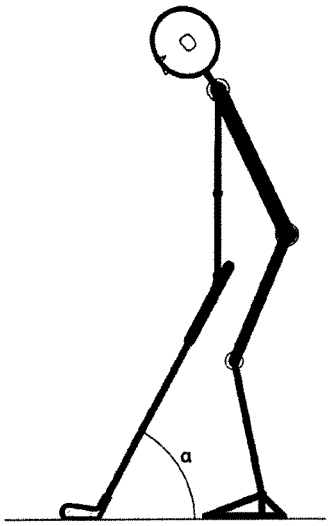
FIG. 2 shows a side view of a user in a position to strike a golf ball.

The Centre of Gravity of the various body members from the spine is calculated with the user in a stance when viewed sideways at an instance of hitting the ball as shown in FIG. 2.

Figure 3:
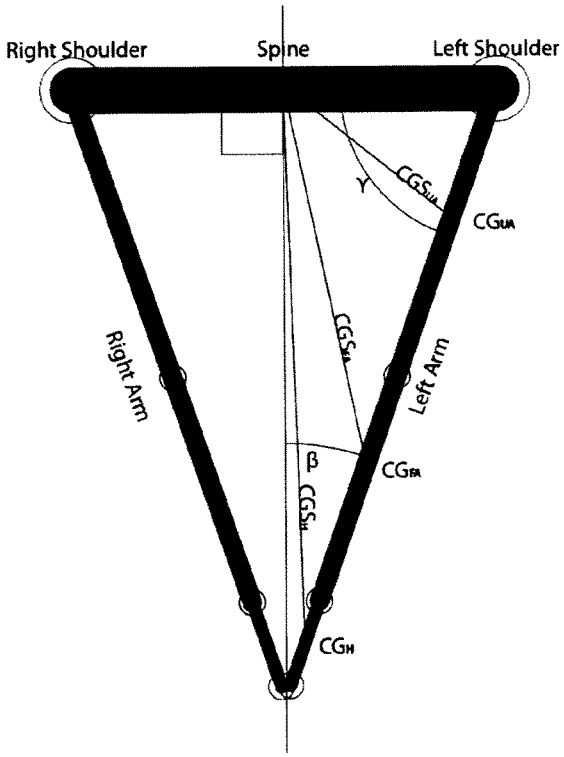
FIG. 3 shows a top view of essential parts of the user's upper body in the position of FIG. 2.

With reference to FIG. 3 which shows a top view of essential parts of the user's upper body with the positions of the respective centres of gravity at an instance of hitting the ball, $$\beta=\tan^{-1}\left(\frac{L_{SW}}{2(L_{UA}+L_{FA}+L_H)}\right)$$

$$\gamma=180°-90°-\beta$$

Using Law of Cosines;

$$c^2=a^2+b^2-2ab\text{Cos}C$$

$$CGS_{UA}=\sqrt{\left(\frac{L_{SW}}{2}\right)^2+CG_{UA}^2-L_{SW}\times CG_{UA}\times\text{Cos}\gamma}$$

$$CGS_{FA}=\sqrt{\left(\frac{L_{SW}}{2}\right)^2+(L_{UA}+CG_{FA})^2-L_{SW}\times(L_{UA}+CG_{FA})\times\text{Cos}\gamma}$$

$$CGS_H=\sqrt{\left(\frac{L_{SW}}{2}\right)^2+(L_{UA}+L_{FA}+CG_H)^2-L_{SW}\times(L_{UA}+L_{FA}+CG_H)\times\text{Cos}\gamma}$$

The Moment of Inertia of the body members around their centre of gravity is estimated as follows:

$$\text{MOI}_{UA}=(M_{UA}\times L^2{}_{UA})/12$$

$$\text{MOI}_{FA}=(M_{FA}\times L^2{}_{FA})/12$$

$$\text{MOI}_H=(M_H\times L^2{}_H)/12$$

The above is not exact, as the centre of gravity does not coincide with the mid point of the member. This has however negligible effect on the overall club mass calculations.

The Moment of Inertia of the body members around the spine is calculated as follows:

$$\underline{\text{MOIS}_{UA}=\text{MOI}_{UA}+M_{\text{UA}}\times\text{CGS}_{\text{UA}}{}^2}$$

$$\underline{\text{MOIS}_{FA}=\text{MOI}_{FA}+M_{\text{FA}}\times\text{CGS}_{\text{FA}}{}^2}$$

$$\underline{\text{MOIS}_H=\text{MOI}_H+M_{\text{H}}\times\text{CGS}_{\text{H}}{}^2}$$

The total Moment of Inertia of the left arm around the spine, as shown in FIG. 2, is thereby:

$$MOIS_{Impact}=MOIS_{UA}+MOIS_{FA}+MOIS_{H}$$

This is the Moment of inertia of the left arm around the spine at impact position.

Figure 4:
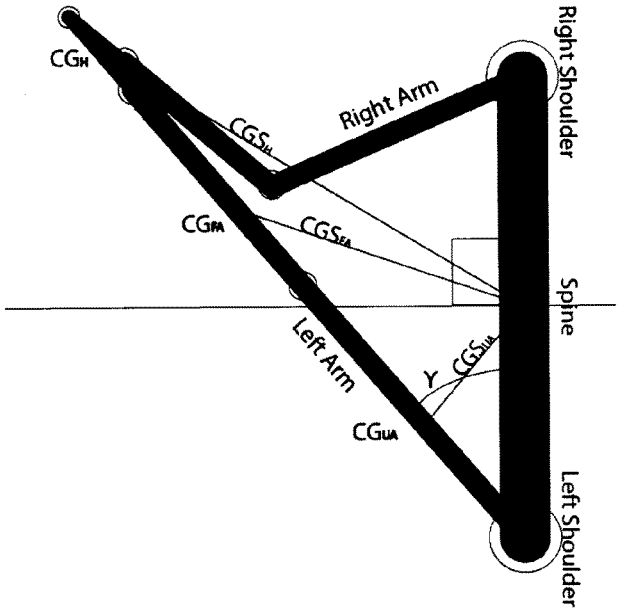
FIG. 4 shows a top view of essential parts of the user's upper body in a position at a top of a backswing.

With reference to FIG. 4 which shows a top view of essential parts of the user's upper body with the positions of the respective centres of gravity at an instance of a top portion of the backswing, it can be seen in comparison with FIG. 3 that the angle between shoulders and left arm is now reduced by 30° at the top portion of the backswing. This is an approximation and may vary from user to user.

Again Using Law of Cosines, $$c^2=a^2+b^2-2ab\ \mathrm{Cos}\ C$$

For Left Arm $$CGS_{UA}=\sqrt{\left(\frac{L_{SW}}{2}\right)^2+CG_{UA}^2-L_{SW}\times CG_{UA}\times \mathrm{Cos}(\gamma-30°)}$$

$$CGS_{FA}=\sqrt{\left(\frac{L_{SW}}{2}\right)^2+(L_{UA}+CG_{FA})^2-L_{SW}\times(L_{UA}+CG_{FA})\times \mathrm{Cos}(\gamma-30°)}$$

$$CGS_{H}=\sqrt{\left(\frac{L_{SW}}{2}\right)^2+(L_{UA}+L_{FA}+CG_{H})^2-L_{SW}\times(L_{UA}+L_{FA}+CG_{H})\times \mathrm{Cos}(\gamma-30°)}$$

The Moment of Inertia of the body members around their centre of gravity is estimated as follows:

$$MOI_{UA}=(M_{UA}\times L_{UA}^2)/12$$

$$MOI_{FA}=\frac{M_{FA}\times L_{FA}^2}{12}$$

$$MOI_{H}=(M_{H}\times L_{H}^2)/12$$

The above is not exact, as the centre of gravity does not coincide with the mid point of the member. However, this has negligible effect on the overall club mass calculations.

The Moment of Inertia of the body members around the spine is calculated as follows:

$$MOIS_{UA}=MOI_{UA}+M_{UA}\times CGS_{UA}^2$$

$$MOIS_{FA}=MOI_{FA}+M_{FA}\times CGS_{FA}^2$$

$$MOIS_{H}=MOI_{H}+M_{H}\times CGS_{H}^2$$

The total Moment of Inertia of the left arm around the spine, as shown in FIG. 4, is thereby:

$$MOIS_{Impact}=MOIS_{UA}+MOIS_{FA}+MOIS_{H}$$

Correction of Club Mass Due to Ball Position and Angle of Impact

Figure 5:
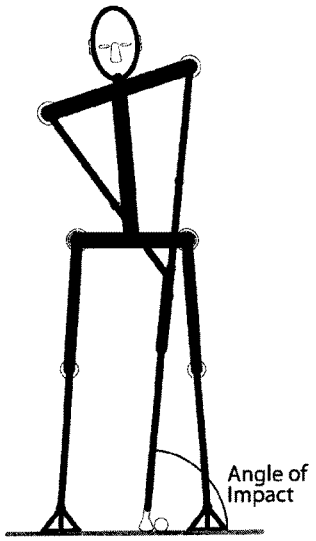
FIG. 5 shows a front view of the user in the position of FIG. 2.

The ball is normally positioned in the middle of the stance for the shortest club and inside the left foot for the Driver as shown in FIG. 5.

Difference in ball position (Lsp) may be measured for the actual user. Some users actually set up with the ball almost in the middle of the stance even for the Driver.

The distance from ball to left shoulder joint is needed for these calculations. From FIG. 2 it can be seen that this distance equals $$L_{BS}=\sqrt{(L_C\times \mathrm{Cos}\alpha)^2+(L_C\times \mathrm{Sin}\alpha\times L_{UA}+L_{FA})^2}$$

α=LieAngle

Impact angle also needs to be considered. This is defined as the angle between the ground and the forward side of the club shaft at impact. This angle is 90 degrees when the club shaft is perpendicular to the ground at impact. This will be the case for the Driver and woods. For all the other clubs the angle will always be less than 90 degrees.

For irons the shaft is considered to be an elongation of the left arm at impact. Angle of impact, δ, for irons is thereby calculated as follows:

$$\delta=\mathrm{Tan}^{-1}\frac{L_{BS}}{L_{BD}}$$

Where $L_{BD}$ is the distance between the ball position for the club in question and that of the Driver.

For each particular club the ball position, $L_{BD}$ is calculated as follows:

$$L_{BD}=\frac{L_{BP}\times L_{Dr}}{L_{Dr}-L_{SC}}-\frac{L_{BP}\times L_{AC}}{L_{Dr}-L_{SC}}$$

$L_{AG}$=Length of Actual Club in question.

$L_{SC}$=Length of the shortest club in the set.

$L_{Dr}$=Length of the longest club in the set, the Driver.

$L_{BP}$=Distance from ball position for Driver to ball position for Shortest Club.

The sector that the left arm is sweeping in the downswing equals the angle between the left arm and the horizontal plus the angle of attack. Let us denote the angle between the left arm and the horizontal ϵ. This angle is simply go degrees minus γ plus 30 degrees, when the ball is in the middle of the stance. 30 degrees is a typical value of the angle in which the left arm is raised relative to the shoulders. Alternatively the angle between the left arm and the horizontal ϵ can be measured for the individual user using video. Normally users will have the same length of the back swing for all the clubs. In this regard, one swing should fit all clubs.

Swing Sector for Irons $$\text{Swing Sector for Irons}=\delta+\epsilon+\phi=\sigma+90°-\gamma+30°+\phi$$

Where ¢ is the component of swing sector due to ball position.

$$\mathrm{Sin}\phi=\frac{L_{BP}-L_{BD}}{L_{BS}}$$

Swing Sector for Woods

If we considered that the Driver shaft at impact is an elongation of a line going through the spine and the centre of the grip, the Angle of Impact would be:

$$\text{Swing Sector for Woods}=90°+30°+\phi$$

Where $\phi$ is the component of swing sector due to ball position.

$$\sin\phi=(L_{BP}-L_{BD})/L_{BS}$$

However this is an approximation of the correct swing sector for the woods. Videos of the swings of professional golfers indicate that even the Driver and the fairway woods have a forward lean at impact. The forward lean is estimated to be halfway between that of the irons and a line perpendicular to the ground. Therefore the swing sector for the woods should be the average value of that calculated for the irons and of that calculated for the woods above.

Swing sector for Woods thereby becomes:

$$\text{SwingSectorForWoods}=(\delta+90-\gamma+30+\phi)(90+30+\phi)/2$$

The actual preferred impact angle may differ between various forms of the golf swing.

Swing Sector for Hybrids

The swing sector for hybrids is best considered as that of the average of Irons and Woods.

$$\text{SwingSectorForHybrids}=((\delta+90-\gamma+30+\phi)(90+30+\phi)/2+(\delta+90-\gamma+30+\phi))/2$$

Moment of Inertia of Left Arm

The average moment of Inertia of the left arm around the spine as it move through the downswing is given as $MOIS_{Arm}$.

$$MOIS_{Arm}=(MOIS_{Top}+MOIS_{In\ pact})/2$$

This gives the average value of the MOIS at the top of the backswing and the MOIS at the point of impact. In reality the MOIS changes throughout the downswing. It should be appreciated that either advanced calculus or computer modeling may be used to give exact calculations.

Moment of Inertia of the left Arm and Club as they swing through the Swing sector around the Spine is denoted $MOIS_{system}$.

$$MOIS_{System}=MOIS_{Arm}+MOIS_{Club}$$

$$MOIS_{Club}=\text{Mass of Club}\times(\text{Distance from Spine})^2$$

Distance from centre of gravity of Club to Spine is $SGS_H$ as calculated earlier for both the top of the backswing position and the impact position. In both cases the club is assumed to be held at 90 degrees to a line drawn from the spine and to the grip of the club. In other words the mass of the club is in the hands of the user. The club has not yet released. For this calculation the average of the two distances (from centre of gravity of Club to Spine) shall be used. Again, the accuracy of these calculations may be improved by either computer modeling or advanced calculus.

The time taken from top of the backswing to impact should be the same for all the clubs. This is consistent with the "one swing for all the clubs" concept. In this regard, the various clubs should have different mass depending on the position of the hands at impact. The Torque applied by the user should also be the same for all the clubs in order to satisfy the "one swing for all the clubs" concept. Torque is denoted by $\tau$. According to Newton's second law:

$$\tau=MOIS_{System}\times\alpha=C$$

Where $\alpha$ is the angular acceleration.

C is a constant that is the same for all the clubs in a matched set.

Further:

$$\Theta=\tfrac{1}{2}\alpha\tau^2 \text{ OR } \alpha=2\Theta/\tau^2$$

where $\Theta$ is the Swing Sector.

$$\tau=MOIS_{System}\times 2\Theta/\tau^2=C$$

The time taken for completing the downswing, t, is constant throughout the set of clubs. Thereby it is given that:

$$MOIS_{System}\times\Theta=C$$

Accordingly, as the swing sector is increased, the mass of the club has to be reduced in order to complete the downswing in the same time for all the clubs. One may calculate C for one club, then work backwards and calculate $MOIS_{System}$ for all the other clubs. From $MOIS_{System}$ the corrected mass of each club can be calculated.

Considering Conservation of Angular Momentum

In an ideal situation, the angular momentum of an isolated system remains constant in both magnitude and direction. The angular momentum is defined as the product of the moment of inertia and the angular velocity. The angular momentum is a vector quantity and the vector sum of the angular momentum of the parts of an isolated system is constant. Consequently, this constrains the types of rotational motions that can occur in an isolated system. If one part of the system is given an angular momentum in a given direction, then some other part or parts of the system must simultaneously be given exactly the same angular momentum in the opposite direction. In view of the aforementioned, through the downswing of a golf swing, the angular momentum is increasing as the body is applying a Torque to the system. However, the release of the club should be considered to occur in an instant at the end of the downswing. This means that the Torque applied by the body in the short period it takes for the club to be released should be ignored. Here the release of the club is defined as the period of time where the club goes from being perpendicular to a line drawn through the spine and the centre of the grip to the time of impact. This implies that the total angular momentum before and after the release is the same.

Angular Momentum is:

$$MOIS_{System}\times\acute{\omega}$$

where $\acute{\omega}$ is the angular velocity and $MOIS_{System}$ is according to earlier calculations.

$$MOIS_{System}=MOIS_{Arm}+MOIS_{Club}$$

BR denotes Before Release, and AI denotes At Impact. Thereby:

$$MOIS_{ArmsBR}\times\acute{\omega}_{BR}+MOIS_{ClubBR}\times\acute{\omega}_{BR}=MOIS_{ArmsAI}\times\omega_{AI}+MOIS_{ClubAI}\times\acute{\omega}_{AI}+MOIG_{Club}\times\acute{\omega}_{Club}$$

However, $MOIS_{ArmsBR}$ equals $MOIS_{ArmAI}$ $$\acute{\omega}_{Club}=\text{club head speed}/(\text{club length}-100\text{ mm})$$

(club length-100 mm) is the length of the club from the centre of the grip down. This is called effective length or $L_{CE}$. Club head speed is denoted $V_{CH}$.

Thereby:

$$(MOIS_{Arms}+MOIS_{ClubBR})\acute{\omega}_{BR}=(MOIS_{Arms}+MOIS_{ClubAI})\omega_{AI}+MOIG_{Club}\times V_{CH}/L_{CE}$$

The unknowns are:

$\acute{\omega}_{BR}$ $\omega_{AI}$

We solve the equation for $V_{CH}$ $$V_{CH}=((MOIS_{Arms}+MOIS_{ClubBR})\acute{\omega}_{BR}-(MOIS_{Arms}+MOIS_{ClubAI})\acute{\omega}_{AI})\times L_{CE}/MOIG_{Club}$$

Thus, in order to increase $V_{CH}$ one may:

Increase $MOIS_{ClubBR}$, in other words increasing the mass of the club.

Increase $\acute{\omega}_{BR}$

Decreasing $MOIS_{ClubAI}$, This can only be done by minimizing the MOIG.

Decreasing $\acute{\omega}_{AI}$, this as the more energy that is converted into club head speed, the lower the $\acute{\omega}_{AI}$ becomes.

Increase the effective club length $L_{CE}$

Decrease $MOIG_{Club}$

It can correspondingly be concluded that to achieve maximum club head speed the MOIG shall be minimized. It can also be concluded that the mass of club should be maximized and that the speed of hands before release should be maximized. These two variables do however affect one another. Typically, as the mass of the club is increased the hand speed before impact is reduced. It is however the product of the two that needs to be maximized. There will be an ideal club mass for each and every user. If the mass of the club is too low, the user generates good hand speed but the angular momentum produced is low. If the mass of the golf club is too high the hand speed will be low and thereby give a low angular momentum. Some users have fast muscles, and will play well with clubs of low mass. Some users have slow muscles and will maximize the angular momentum created at a lower speed using a golf club of high mass.

Considering Conservation of Energy

For rotation of objects, the net work is equal to the change in rotational kinetic energy:

$$W_{net}=\tfrac{1}{2}I\acute{\omega}^2_1-\tfrac{1}{2}I\acute{\omega}^2_1$$

As the angular velocity at the top of the backswing is zero, so is the initial kinetic energy. Kinetic rotational energy thereby becomes:

$$E_K=\tfrac{1}{2}I\omega^2$$

For a constant torque, the work can be expressed as $$W=\tau\times\theta$$

The work exerted by the body on the golf club can be described as the torque applied by the user through an angle from top of the backswing to the point of impact. This is thereby a constant that describes the energy supplied to the golf club by a particular user. This constant is specific to the individual user.

The golf swing consist of two rotational movements imposed on each other, namely, a rotation of the club around the left shoulder and the rotation of the club around the centre of the grip position on the club.

For the rotation of the club around the left shoulder, the kinetic energy is:

$$E_{AO}=\tfrac{1}{2}I\acute{\omega}^2-\tfrac{1}{2}M_{Club}L^2_A v^2_H/L^2_A-\tfrac{1}{2}M_{Club}v^2_R$$

$$\underline{\text{where}\,L_A=L_{UA}+L_{FA}+L_H}$$

For the rotation of the club around the centre of the grip position on the club, the energy is:

$$E_{KClub}=\tfrac{1}{2}I\acute{\omega}^2=\tfrac{1}{2}\text{MOIG}\ V^2_{CH}/L^2_{CE}$$

where $L_{CE}$ is the club length from the grip centre down, or effective length of Club.

Based on the principle of conservation of energy the sum of the above two must be equal to the work exerted by the user. The work exerted by the user is a constant describing the abilities of the user. Thereby:

$$\frac{1}{2}M_{Club}v_H^2+\frac{1}{2}MOIG\frac{v_{CH}^2}{L_{CE}^2}=\text{Constant}$$

During most of the downswing the $E_{AO}$ is the dominant part. However as the club is released the $E_{AI}$ becomes the dominant part as the velocity of the hands almost becomes zero at impact. Making the assumptions that the speed of the hands becomes zero exactly as the club releases, and that the club only releases at the bottom of the swing, all the work done on the club will go into the $E_{AO}$, then at the very end all this energy is transferred into $E_{KClub}$. As such:

$$\tfrac{1}{2}M\text{Club}\ v2H=\tfrac{1}{2}\text{MOIG}\ v^2_{CH}/L^2_{CE}$$

In addition, assuming the downswing is arching θ degrees and that the downswing is carried out in t seconds. Then $$v_H^2=\frac{\theta\times L_A}{t}$$

It is noted that θ, $L_A$ and t are all factors specific to the user. Therefore $v^2_H$ can be substituted with a Constant specific to the particular user called $C_{Golfer}$.

Then $$\tfrac{1}{2}M_{Club}\times C_{Golfer}=\tfrac{1}{2}\text{MOIG}\ v^2_{CH}/L^2_{CE}$$

Hence, $$C_{Golfer}=(\text{MOIG}\times v^2_{CH})/(M_{Club}\times L^2_{CE})$$

In view of the preceding equation, it should be noted that:

By decreasing the MOIG the club head speed is increased. One should thereby seek to minimize the MOIG throughout the set of golf clubs.

By increasing the mass of the club, the club head speed correspondingly increases. There will however be a point where a user would not be able swing the club efficiently.

By increasing the length of the club the club head speed correspondingly increases.

Thus, it should be noted that the weight of the club should be manageable and that shaft and club head mass should be minimized in order to maximize club head speed.

Furthermore, it should be noted that $V_{CH}$ is proportional to $L_{CE}$. That is $V_{CH}^2/L_{CE}^2$ is a constant.

Correspondingly, we can define a new Constant BioMatch Index or BMI as $MOIG/M_{Club}$.

$$\text{BMI}=\text{BioMatch-Index}=\text{MOIG}/M_{Club}$$

The BMI should thereby be constant throughout the set of golf clubs (not including the putter). This will make all the clubs behave in the same manner. It should be noted that the MOIG and $M_{Club}$ values can be varied as long as BMI remains constant. Furthermore, it should be appreciated that variables such as, for example, ball position, hand position at impact, air resistance and so forth are not taken into consideration. In this regard, actual BMI for each club will differ slightly from the aforementioned calculations.

The information in the preceding paragraphs is useful when the user needs to match an existing golf set and is not able to modify the mass of the club heads in order to adjust the MOIG. The set can thereby be matched by adjusting the total mass of each club by adjusting the grip end weight once the BMI has been determined.

Once the correct MOIG and Mass of each club are determined as in the earlier calculations taking air resistance and hand position at impact into account, the optimal BMI can be calculated for each club. This is very useful if say the Driver have to be made shorter than what is preferred in order to achieve the correct MOIG. One may then make the Driver in whatever length is preferred and then adjust the mass of the club by adjusting the back weight in order to achieve the correct BMI. As the length will affect the MOIG this has to be re-measured or recalculated.

The Fitting Procedure

The information provided in the preceding paragraphs provide substantive basis for a method 20 for matching golf clubs to a specific user. The method 20 provides further details in relation to processes carried out for the method 20.

The method 20 for matching golf clubs to a specific user includes providing both a height and a weight of the specific user (22). Data pertaining to the height and weight of the specific user should be provided as the data is required to determine physical parameters of the specific user (24) such as:

length, mass, position of centre of gravity of each upper arm;

length, mass, position of centre of gravity of each forearm;

length, mass, position of centre of gravity of each hand; and distance of shoulder width.

It should be appreciated that this has been detailed in preceding portions of the description.

The method 20 also includes providing data for each golf club (26), where the data for each golf club includes:

type of each golf club (iron, wood, or hybrid);

mass of each golf club;

length of each golf club;

measured moment of inertia about a grip centre value of each golf club;

lie angle of each golf club;

club head drag coefficient of each golf club;

club head width of each golf club; and club head height of each golf club.

Subsequently, the method 20 also includes obtaining optimal club mass for a Driver (28). The optimal club mass of the Driver is obtained using a process including measuring Driver head speed when swinging the Driver with different weights added to a grip end of the Driver, where the optimal club mass of the Driver is when the Driver head speed is at a highest value. It should be appreciated that ascertaining the optimal club mass of the Driver may be done visually with the use of graphs with axes of head speed vs mass of Driver. The use of graphs may be preferable as interpolation within intermediate points may be carried out using the graphs.

The method 20 includes obtaining optimal values of both a MOIG and a mass for each golf club (30). Reference is made to the preceding paragraphs of the description in relation to how optimal values of both the MOIG and the mass for each golf club are obtained. It should be appreciated that the preceding paragraphs provide repeatable factual basis in relation to the provision of the optimal values of both the MOIG and the mass for each golf club.

There is also a step in the method 20 of modifying each golf club to enable each golf club to attain the aforementioned optimal values (32). The modification of each golf club includes at least one technique such as, for example, adjustment of club head weights, adjustment of club lengths, and adjustment of club weights, and so forth. The adjustment of club weights is carried out using a plurality of cylindrical sleeves of varying masses, with a centre of gravity of each cylindrical sleeve being at the grip centre of each golf club.

With the application of the method 20, it is advantageous that each of the golf clubs matched to the specific user are effectively employed with an application of identical swings from the specific user. It should be appreciated that the effective employment of each of the golf clubs relates to both distance and accuracy of a ball struck by each of the golf clubs. When the user utilizes golf clubs which have been subject to the method 20, the user is able to swing each club without trying to manipulate the club with the wrists in order to make up for incorrect club matching. This is advantageous in relation to accuracy. This also has the effect that the club swings faster as there is less resistance in the wrists. This occurs when the user trusts each club and thereby loosens up the wrists.

Figure 10:
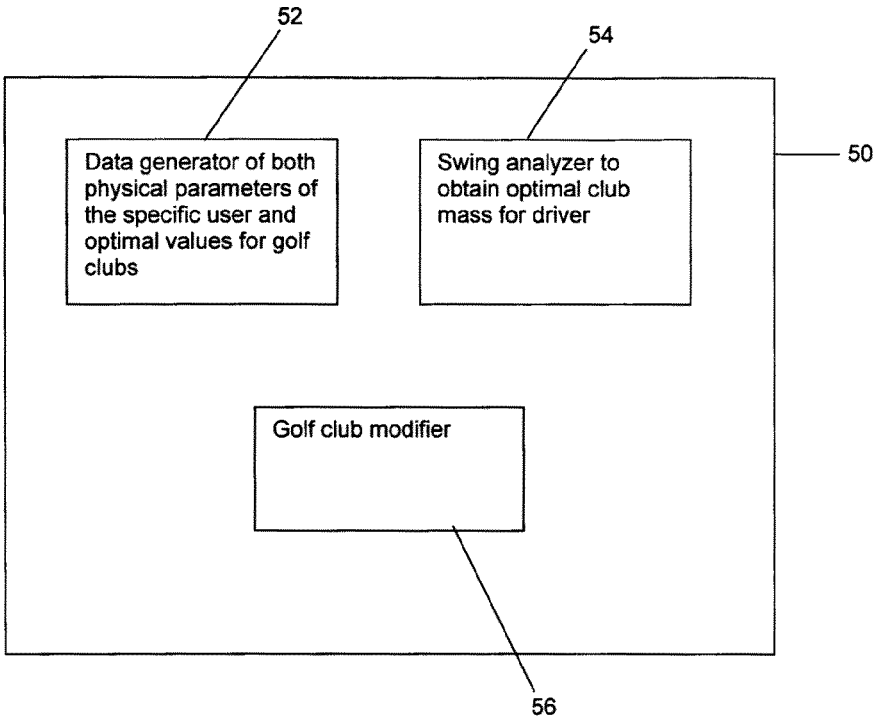
FIG. 10 shows a schematic view for a system of the present invention.

Referring to FIG. 10, there is also provided a system 50 for performing the method 20. The system 50 may be set up with a plurality of modules to carry out processes of the method 20, the modules being located at either a single location or a plurality of locations. It should be appreciated that the plurality of locations may be in different states/countries. The plurality of modules include a data generator of both physical parameters of the specific user and optimal values for golf clubs (52), a swing analyzer to obtain an optimal club mass for a Driver (54); and a golf club modifier to modify each golf club (56). The optimal values are for both a MOIG and a mass for each golf club.

The data generator (52) module employs the techniques as described in detail in the preceding paragraphs. The data generator (52) module should include a data processor to process data input into the data generator (52) module. The requisite data required by the data generator (52) module may be provided in a form as illustrated in FIG. 8, while the output from the data generator (52) module may be in a form as illustrated in FIG. 9. The form as illustrated in FIG. 9 may be used by the golf club modifier (56) module to modify golf clubs for the specific user in an appropriate manner. It should be appreciated that the golf club modifier (56) module may be in a form of an automated process with little or no human intervention.

The swing analyzer (54) module may employ any known swing analyzing processes, which typically would include use of a video camera to capture images of the user executing a golf swing. It should be appreciated that the swing analyzer (54) module may also be in a form of an automated process with little or no human intervention.

Other embodiments of the invention are described in the following paragraphs. Currently, one typically adds weight to golf clubs by removing the center part of the rubber grip end to gain access to the inside of the golf shaft. One may thereby fix a mechanical weight inside the shaft of the golf club. One example device is described in U.S. Pat. No. 7,481,716.

It would be advantageous if there was a method of inserting weight in the club without cutting the grip 106. It would also be an advantage if the weight could be delivered granularly, where available in any desired weight readily and in a controlled weight gradient. It would also be desirable to have fine control of weights delivery in increments as little as about one gram and upward.

Figure 11:
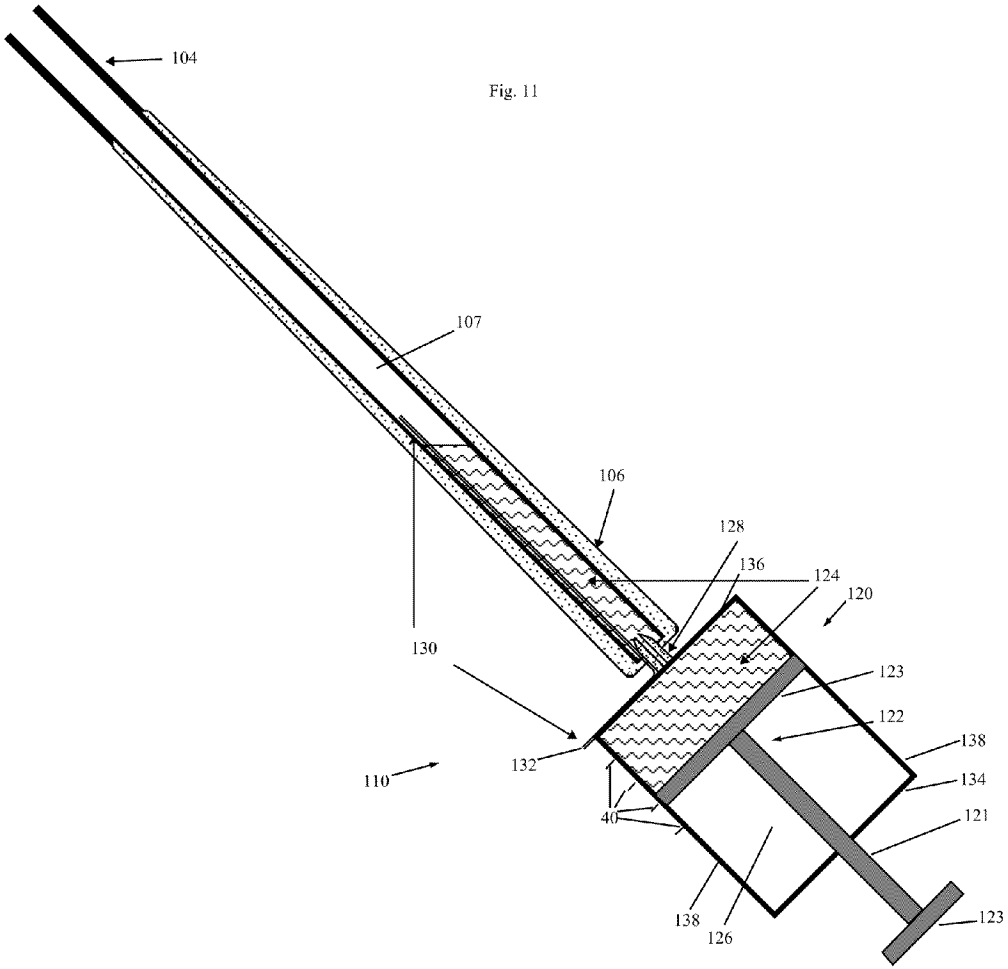
FIG. 11 shows a side view of an alternate embodiment of the present invention.

FIG. 11 displays an embodiment according to the current invention. It illustrates a dispensing gun 120 and a weighted filler 124.

The dispensing gun 120 further includes a reservoir 126, a piston 122, nozzle 128, and an optional pressure release conduit 130. The reservoir 126 is a substantially sealed having a known volume. It includes a top wall 134, a bottom wall 136, and sidewalls 138. The walls may comprise metal, plastic, or other material depending on the weighted filler 124 and other factors. The sidewalls 138 present a longitudinal axis generally parallel to them. The enclosed interior of the dispensing gun 120 defines the reservoir 126 which is operable to contain a weighted filler 124 (disclosed below). Optionally, the sidewalls 138 include visual markings 140 denoting the used and unused volume weighted filler 124. In one configuration, the sidewalls 138 or a portion thereof contain a window enabling visual access to the reservoir 126.

The dispensing gun 120 includes a piston 122 operable to deliver pressure across the reservoir 126. The exemplary piston 122 includes a push rod 121 oriented generally along the axis presented by the sidewalls 138. The illustrated push rod 121 has a proximal end and a distal end and is slidably engaged to an opening in the reservoir 126. A distal end of the push rod 121 is secured to a head 123. The head 123 is dimensioned to span and sealably engaged the sidewalls 138. The piston 122 further includes structure to deliver a force to it such that that the head 123 travels along the longitudinal axis presented by the sidewalls 138, preferably delivering a transverse force to the head 123. The illustrated piston includes a handle 142 secured to the push rod 121 for manual application of force. Alternate configurations include a motor (not pictured) secured to the push rod 121. In another alternate configuration, a compressor (not pictured) applies pneumatic pressure to reservoir 126, driving the head 123.

The dispensing gun 120 includes a nozzle 128, where the weighted filler 124 exits the device 110. The nozzle 128 includes an outlet with a suitable inner width to permit exit of the weighted filler 124 given viscosity and any granule particle widths. The nozzle's 128 outer width is dimensioned to enable slidable insertion into the golf club grip ventilation hole.

Optionally, the device 110 includes a pressure release tube 130 in order to facilitate removal of air displaced by injected weighted filler 124 and maintaining neutral pressure in the golf club interior 107. A segment of the pressure release tube 130 is secured adjacent the nozzle 128. A second adjoined segment of the pressure release tube 130 extends distally to the end of the nozzle 128 such that the end of the pressure release tube 130 maintains fluid contact with air in the interior 107 of the golf club past the injection site of the weighted filler 124 and completes the fluid communication channel from the interior 107 of the golf club to the ambient air.

The weighted filler 124 is an initially viscous material delivered from the reservoir 126 of the dispensing gun 120 to the interior 107 of a golf club. The weighted filler 124 comprises initially viscous material which cures into a harder form after delivery to the golf club interior 107. A suitable weighted filler 124 transforms from its initial state to a harder cured state. A suitable weighted filler 124 should have an initial viscosity to readily penetrate the golf club ventilation hole 108. It is contemplated that the viscosity of the initial composition can be selected to achieve the desired result, the viscosity of such composition can be from about 25 centipoise (cps) to about 250,000 cps or any range or integer derivable therein as measured on a viscometer in normal atmospheric conditions. In another aspect, the initial composition can be from about from about 50 cps to about 175,000 cps. In another aspect, the initial composition can be from about 1,000 cps to about 100,000 cps. A diluent or thickener can be included as necessary. Representative diluents include water, isopropyl alcohol, and others known in the art.

Suitable weighted filler 124 should also have an effective density in order to add a desired weight to the interior 107 of the golf club or more preferably add a desired weight to a portion of the interior. In one configuration, the weighted filler 124 ranges from about 1.0 g/cm$^3$ to about 20.0 g/cm$^3$. In another configuration, the weighted filler 124 ranges from about 1.0 g/cm$^3$ to about 8.0 g/cm$^3$. In yet another configuration, the weighted filler 124 ranges from about 0.50 g/cm$^3$ to about 7.0 g/cm$^3$. In yet another configuration, the weighted filler 124 ranges from about 0.50 g/cm$^3$ to about 5.0 g/cm$^3$. In order to achieve a desired average or effective density, a higher density material can be added to the base composition. Nonexclusive examples of higher density materials for inclusion are metals. An exemplary metal additive is tungsten. In exemplary configuration, the higher density material is shaped and dimensioned as fine granules of less than about two millimeters width.

As disclosed, the weighted filler 124 cures from its originally viscous state to a cured or hardened state. The suitable weighted filler 124 enables such curing. The exemplary curing agent is air but chemical additives, heat, and other curing agents or processes known within the art are within the spirit of this invention.

In some situations, it may be desirable to readily remove some the weighted filler 124 after its application. In one configuration, the weighted filler 124 is specifically selected to support removal after curing. To support such a configuration, the cured weighted filler 124 is soluble, partially soluble, or flakes upon mechanical contact.

Taking into account the above disclosed properties, representative, nonexclusive examples of weighted filler 124 base liquid compositions include rubber, plastics, silicon, epoxy, elastomers, and others known in the art.

Figure 12:
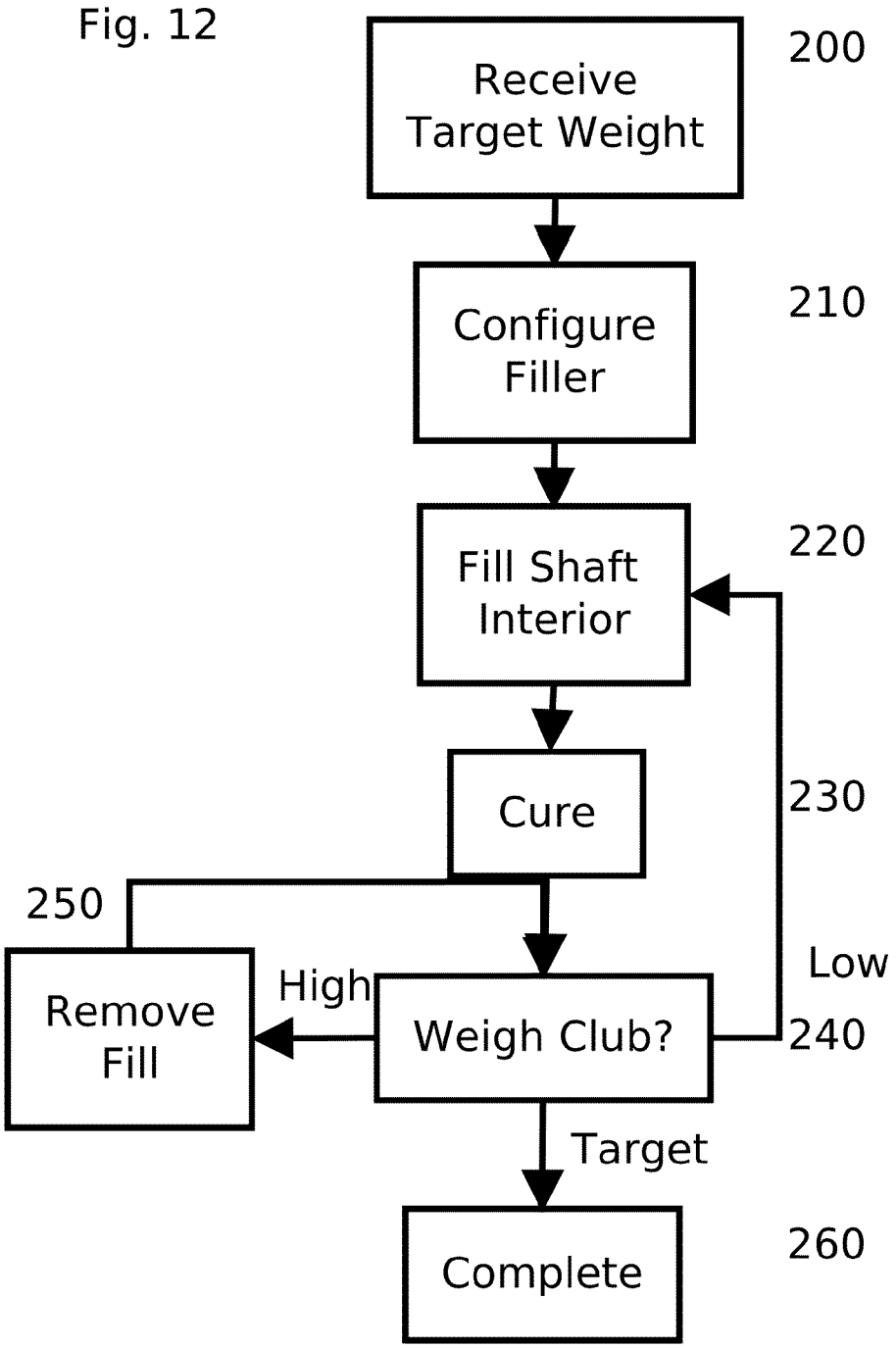
FIG. 12 show an alternate process flow for a method of the present invention.

Now referring to FIG. 12, a process according to the current invention is disclosed. A target weight for the golf club is received 200. The weight filler 124 is configured for the target weight 210. The weighted filler 124 is injected into the golf club interior 220. The weighted filler cures 230. The golf club is weighed compared to its target weight 240 and adjusted 240 250 as necessary until the target weight is reached 260. More consideration to the each of the steps will be considered below.

At step 200, the target additional weight for the golf club is received. This target weight may be received as disclosed in this specification or from a separate source. This target additional weight can include weight position information, that is to say a gradient with respect to the distribution of the additional weight.

At step 210, the weighted filler 124 is configured. A composition of suitable viscosity, suitable density, and cure rate is selected based on the target additional weight and other usability factors. The weighted filler 124 is placed in the reservoir 126. The piston 122 head 123 is sealably placed over the weighted filler 124.

At step 220, the weight filler 124 is delivered to golf club shaft interior 107. The nozzle 128 and pressure release tube 130 are inserted through the ventilation hole 108 into the interior 07 of the golf club. The handle 142 is manipulated to apply pressure to the head 123 and, in turn, deliver the weighted filler 124 into the interior 107 of the golf club.

At step 230, the weight filler 124 is cured. While curing, the golf club may be selectively angularly oriented relative in order to alter the flow of the weighted filler 124. The selective angular orientation is used to control the weight gradient golf club. For example, the golf club would be placed in a vertical position with the grip end of the club down towards the ground for a low weight distribution.

At step 240, the golf club is weighed and compared to the target total weight. The overall weight of the club can be measured with a scale. The total weight equals the target weight, the process is complete 260. If the total weight is lower than the target weight, step 220 and step 230 are repeated. If the total weight is lower than the target weight, weighted filler 124 is removed 250.

Where it is necessary to remove weighted filler 124, one sub-step within the current invention employs mechanical action to sever pieces of the weighted filler 124. For example, it can be removed by drilling out the material. A second sub-step of the invention includes dissolving a portion of the weighted filler 124. A solvent is selected according to the composition of the weighted filler 124. For example, ethyl alcohol, acetone, or methyl chloride may be applied to the cured weighted filler 124. The solution may be removed by vacuum pressure employing such devices as a syringe or similar steps.

Whilst there has been described in the foregoing description preferred embodiments of the present invention, it will be understood by those skilled in the technology concerned that many variations or modifications in details of design or construction may be made without departing from the present invention.

Although this invention has been described with reference to an illustrative embodiment, this description is not intended to limit the scope of the invention. Various modifications and combinations of the illustrative embodiments as well as other embodiments of the invention will be apparent to persons skilled in the art upon reference to the description. It is therefore intended that the appended claims accomplish any such modifications or embodiments.

I claim:

1. A method for adjusting the weight of a golf club, the method including:

receiving a target additional weight for a golf club;

selecting a weighted filler of a configured viscosity and configured density corresponding to said additional weight;

providing a dispensing gun comprising a piston, a reservoir, and a nozzle, said dispensing gun further comprises pressure release tubing;

injecting an amount of said weighted filler in the interior of said golf club corresponding to said additional weight; and permitting said weighted filler to cure.

2. The method of claim 1, wherein said configured viscosity is from about 25 centipoise to about 250,000 centipoise.

3. The method of claim 1, wherein said configured viscosity is from about 1,000 centipoise to about 100,000 centipoise.

4. A system for adjusting the weight of a golf club, said system comprising:

a dispensing gun and a weighted filler;

said dispensing gun comprising a plurality of walls bounding a substantially sealed reservoir;

a head sealably disposed in said reservoir spanning opposing walls;

said weighted filler comprising a viscous, curing material of a density range corresponding to the interior of said golf club;

said dispensing gun including a nozzle, said nozzle dimensioned for slidable placement into a golf club ventilation hole and presenting an outlet, said dispensing gun secured to a pressure release tubing, a segment of said pressure release tubing adjacent said nozzle and extending distally therefrom, whereby pressure is applied to the head and weight filler is injected into said interior of said golf club.

5. A system for adjusting the weight of a golf club, said system comprising:

a dispensing gun and a weighted filler;

said dispensing gun comprising a plurality of walls bounding a substantially sealed reservoir;

a head sealably disposed in said reservoir spanning opposing walls;

said weighted filler comprising a viscous, curing material of a density range corresponding to the interior of said golf club, wherein said viscosity of said weighted filler is from about 25 centipoise to about 250,000 centipoise;

said dispensing gun including a nozzle, said nozzle dimensioned for slidable placement into a golf club ventilation hole and presenting an outlet, whereby pressure is applied to the head and weight filler is injected into said interior of said golf club.

6. The system of claim 5, wherein said viscosity of said weighted filler is from about 1,000 centipoise to about 100,000 centipoise.

* * * * *